US010589948B2

(12) United States Patent
Inui

(10) Patent No.: US 10,589,948 B2
(45) Date of Patent: Mar. 17, 2020

(54) SHEET FEEDING APPARATUS

(71) Applicant: CANON KABUSHIKI KAISHA, Tokyo (JP)

(72) Inventor: Yuma Inui, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/135,152

(22) Filed: Sep. 19, 2018

(65) Prior Publication Data

US 2019/0119059 A1 Apr. 25, 2019

(30) Foreign Application Priority Data

Oct. 20, 2017 (JP) ..... 2017-203969

(51) Int. Cl.

| | |
|---|---|
| ***B65H 7/02*** | (2006.01) |
| ***B65H 3/52*** | (2006.01) |
| ***B65H 3/56*** | (2006.01) |
| ***B65H 3/06*** | (2006.01) |

(Continued)

(52) U.S. Cl.

CPC ..... *B65H 3/5223* (2013.01); *B65H 1/14* (2013.01); *B65H 3/0661* (2013.01); *B65H 3/0676* (2013.01); *B65H 3/5284* (2013.01); *B65H 3/56* (2013.01); *B65H 7/02* (2013.01); *B65H 7/18* (2013.01); *B65H 2404/1441* (2013.01); *B65H 2405/1136* (2013.01); *B65H 2511/13* (2013.01); *B65H 2511/414* (2013.01); *B65H 2511/415* (2013.01); *B65H 2511/416* (2013.01); *B65H 2515/30* (2013.01); *B65H 2701/1916* (2013.01)

(58) Field of Classification Search

CPC ... B65H 1/14; B65H 1/18; B65H 7/02; B65H 7/18; B65H 3/0684; B65H 3/5261; B65H 2404/1441

See application file for complete search history.

(56) References Cited

U.S. PATENT DOCUMENTS 5,228,673 A * 7/1993 Osonoe ..... B65H 1/04 271/10.01
5,451,043 A * 9/1995 Arai ..... B65H 3/5215 271/121

(Continued)

FOREIGN PATENT DOCUMENTS

JP H11-193139 A 7/1999
JP 2005-320094 A 11/2005

*Primary Examiner* — Howard J Sanders
(74) *Attorney, Agent, or Firm* — Venable LLP

(57) ABSTRACT

A sheet feeding apparatus includes a disengagement mechanism to disengage a rotary feeding member and a separation member to be apart from each other, a pressing portion to press an upper face of a sheet supported on a sheet supporting portion, and a detector to detect displacement of the sheet pressed by the pressing portion. A controller executes one mode among a plurality of modes to feed the sheet supported on the sheet supporting portion based on a detection result of the detector. In a first feed mode, a leading edge of the sheet passes a position of a separation portion with the rotary feeding member and the separation member disengaged by the disengagement mechanism. In a second feed mode, the leading edge of the sheet passes the separation portion with the rotary feeding member and the separation member engaged.

18 Claims, 10 Drawing Sheets

(51) Int. Cl.
*B65H 1/14* (2006.01)
*B65H 7/18* (2006.01)

(56) References Cited

U.S. PATENT DOCUMENTS

| | | | | |
|---|---|---|---|---|
| 6,712,357 | B1 * | 3/2004 | Tranquilla | B65H 5/062 271/258.01 |
| 6,969,065 | B2 * | 11/2005 | Inoue | B65H 5/062 271/227 |
| 7,533,878 | B2 * | 5/2009 | Cook | B41J 13/0018 271/10.09 |
| 8,511,674 | B2 * | 8/2013 | Koga | B65H 3/5261 271/122 |
| 9,938,097 | B2 * | 4/2018 | Murakami | B65H 3/0684 |
| 9,969,582 | B2 * | 5/2018 | Morimoto | B65H 5/062 |
| 2012/0025453 | A1 * | 2/2012 | Yamaguchi | B65H 3/0607 271/225 |
| 2018/0239295 | A1 * | 8/2018 | Fujinuma | G03G 15/70 |
| 2019/0077621 | A1 * | 3/2019 | Kato | B65H 3/0684 |
| 2019/0193971 | A1 * | 6/2019 | Nakajima | B65H 7/02 |

* cited by examiner

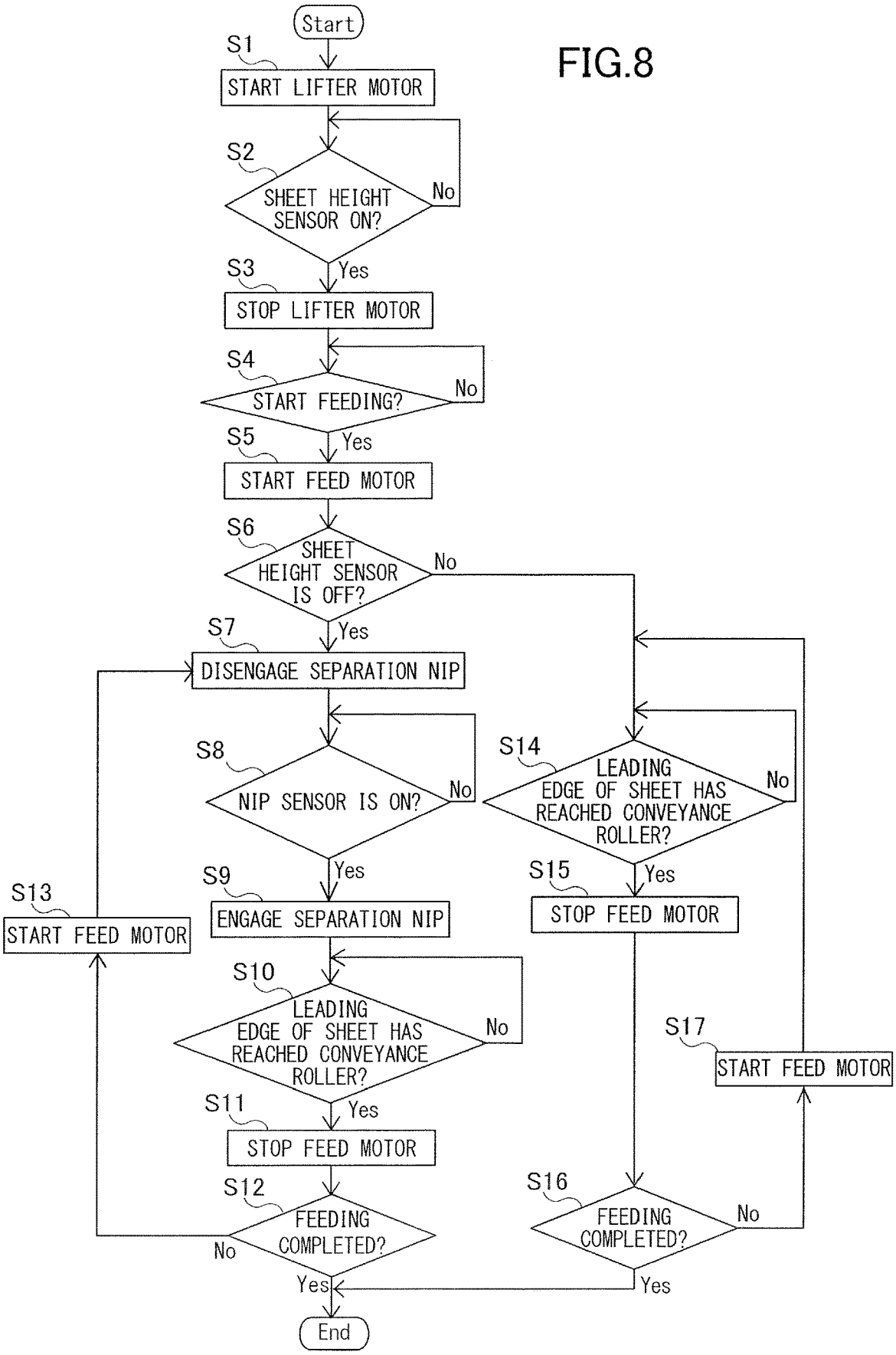
FIG.8
Start
S1
START LIFTER MOTOR
S2
SHEET HEIGHT SENSOR ON?
No
Yes
S3
STOP LIFTER MOTOR
S4
START FEEDING?
No
Yes
S5
START FEED MOTOR
S6
SHEET HEIGHT SENSOR IS OFF?
No
Yes
S7
DISENGAGE SEPARATION NIP
S8
NIP SENSOR IS ON?
No
Yes
S9
ENGAGE SEPARATION NIP
S10
LEADING EDGE OF SHEET HAS REACHED CONVEYANCE ROLLER?
No
Yes
S11
STOP FEED MOTOR
S12
FEEDING COMPLETED?
No
Yes
S13
START FEED MOTOR
S14
LEADING EDGE OF SHEET HAS REACHED CONVEYANCE ROLLER?
No
Yes
S15
STOP FEED MOTOR
S16
FEEDING COMPLETED?
No
Yes
S17
START FEED MOTOR
End

SHEET FEEDING APPARATUS

BACKGROUND OF THE INVENTION

Field of the Invention

The present invention relates to a sheet feeding apparatus configured to feed sheets.

Description of the Related Art

Sheet feeding apparatuses used in image forming apparatus, such as printers, copying machines and multifunction machines, widely adopt a configuration including a rotary feeding member such as a feed roller and a separation member that contacts the rotary feeding member and separates a sheet by frictional force. The sheet being conveyed by a pickup roller arranged upstream of the rotary feeding member enters a separation portion between the rotary feeding member and the separation member, and is fed one by one in a state separated from other sheets by the separation member. The sheet feeding apparatuses adopting such configuration are known to have a drawback in that, depending on an angle of entry of the sheet with respect to the separation portion, the sheet may be jammed and may not pass the separation portion.

Japanese Patent Application Laid-Open Publication No. 2005-320094 discloses an apparatus for feeding envelopes including a support table on which envelopes enclosing sheet products such as stamps and cards are supported, and a roller pair composed of a feed roller and a gate roller, wherein the envelopes are fed while being separated by the gate roller separates. This apparatus is capable of changing a posture of the support table so that a posture of the envelope supported on the support table is kept horizontal with respect to a conveyance direction of the envelope at the nip portion of the roller pair, according to which jamming of the envelope in the nip portion can be prevented.

However, if it is necessary to feed sheets having bulkiness in the thickness direction, such as envelopes, paper medicine bags and sheets that are curled, the method taught in Japanese Patent Application Laid-Open Publication No. 2005-320094 of changing the posture of the support table supporting the sheets is not sufficient in preventing the occurrence of jamming of sheets. That is, if the bulky sheet attempts to enter the nip portion in a state where a leading edge of the sheet is inclined toward the gate roller, the sheet may be jammed in the gate roller upstream of the nip portion and may not pass through the nip portion. Meanwhile, simply deteriorating separation performance of the gate roller in order to allow the envelope to pass through the nip portion may result in another problem of multiple feeding of the sheets in conveying flat sheets such as plain paper.

SUMMARY OF THE INVENTION

The present invention provides a sheet feeding apparatus with high separation performance of sheets capable of reducing sheet jamming.

According to one aspect of the invention, a sheet feeding apparatus includes: a sheet supporting portion on which a sheet is supported; a sheet feed unit configured to feed a sheet supported on the sheet supporting portion in a sheet feeding direction, the sheet feed unit including a rotary feeding member configured to rotate in contact with the sheet; a separation member configured to contact the rotary feeding member such that a separation portion to separate the sheet fed by the rotary feeding member from another sheet is formed between the rotary feeding member and the separation member; a disengagement mechanism configured to disengage the rotary feeding member and the separation member to be apart from each other; a pressing portion configured to press an upper face of the sheet supported on the sheet supporting portion; a detector configured to detect displacement of the sheet in a vertical direction in a case where the pressing portion presses the upper face of the sheet supported on the sheet supporting portion; and a controller configured to execute one mode among a plurality of modes to feed the sheet supported on the sheet supporting portion based on a detection result of the detector, the plurality of modes including a first feed mode in which the sheet is fed such that a leading edge of the sheet in the sheet feeding direction passes a position of the separation portion in a state where the rotary feeding member and the separation member are disengaged by the disengagement mechanism, and a second feed mode in which the sheet is fed such that the leading edge of the sheet passes the separation portion in a state where the rotary feeding member and the separation member are engaged.

According to another aspect of the invention, a sheet feeding apparatus includes: a sheet supporting portion on which a sheet is supported; a sheet feed unit configured to feed a sheet supported on the sheet supporting portion in a sheet feeding direction, the sheet feed unit including a rotary feeding member configured to rotate in contact with the sheet; a separation member configured to contact the rotary feeding member such that a separation portion to separate the sheet fed by the rotary feeding member from another sheet is formed between the rotary feeding member and the separation member; a disengagement mechanism configured to disengage the rotary feeding member and the separation member to be apart from each other; an input unit through which a sheet type of the sheet supported on the sheet supporting portion is input; and a controller comprising a memory configured to store the sheet type input through the input unit and a processor accessible to the memory, the controller being configured to execute one mode among a plurality of modes to feed the sheet supported on the sheet supporting portion based on the sheet type stored in the memory, the plurality of modes including a first feed mode in which the sheet is fed such that a leading edge of the sheet in the sheet feeding direction passes a position of the separation portion in a state where the rotary feeding member and the separation member are disengaged by the disengagement mechanism, and a second feed mode in which the sheet is fed such that the leading edge of the sheet passes the separation portion in a state where the rotary feeding member and the separation member are engaged.

According to still another aspect of the invention, a sheet feeding apparatus includes: a sheet supporting portion on which a sheet is supported; a sheet feed unit configured to feed a sheet supported on the sheet supporting portion in a sheet feeding direction, the sheet feed unit comprising a rotary feeding member configured to rotate in contact with the sheet; a separation member configured to contact the rotary feeding member such that a separation portion to separate the sheet fed by the rotary feeding member from another sheet is formed between the rotary feeding member and the separation member; a disengagement mechanism configured to disengage the rotary feeding member and the separation member to be apart from each other; a sheet sensor configured to detect the sheet at a position downstream of the separation portion in the sheet feeding direction; and a controller configured to control the disengagement mechanism such that the sheet feed unit starts feeding the sheet in a state where the rotary feeding member and the separation member are engaged with each other, and if the sheet sensor does not detect the sheet within a predetermined time after the sheet feed unit has started feeding the sheet, the rotary feeding member and the separation member are disengaged by the disengagement mechanism.

Further features of the present invention will become apparent from the following description of exemplary embodiments with reference to the attached drawings.

BRIEF DESCRIPTION OF THE DRAWINGS

FIG. 8 is a flowchart illustrating a method for controlling a feeding operation according to the first embodiment.

DESCRIPTION OF THE EMBODIMENTS

Now, a sheet feeding apparatus according to the present disclosure will be described with reference to the drawings. The sheet feeding apparatus is used as an apparatus for feeding sheets used as storage medium or document to be copied in the image forming apparatus. The image forming apparatus includes a printer, a copying machine, a facsimile and a multifunction printer, and forms an image on a sheet based on image information entered from an external personal computer (PC) or image information read from a document. The sheet used as storage medium can be paper such as plain paper or a thick paper, and special paper such as plastic films for overhead projectors, cloth, coated paper and so on.

Figure 1:
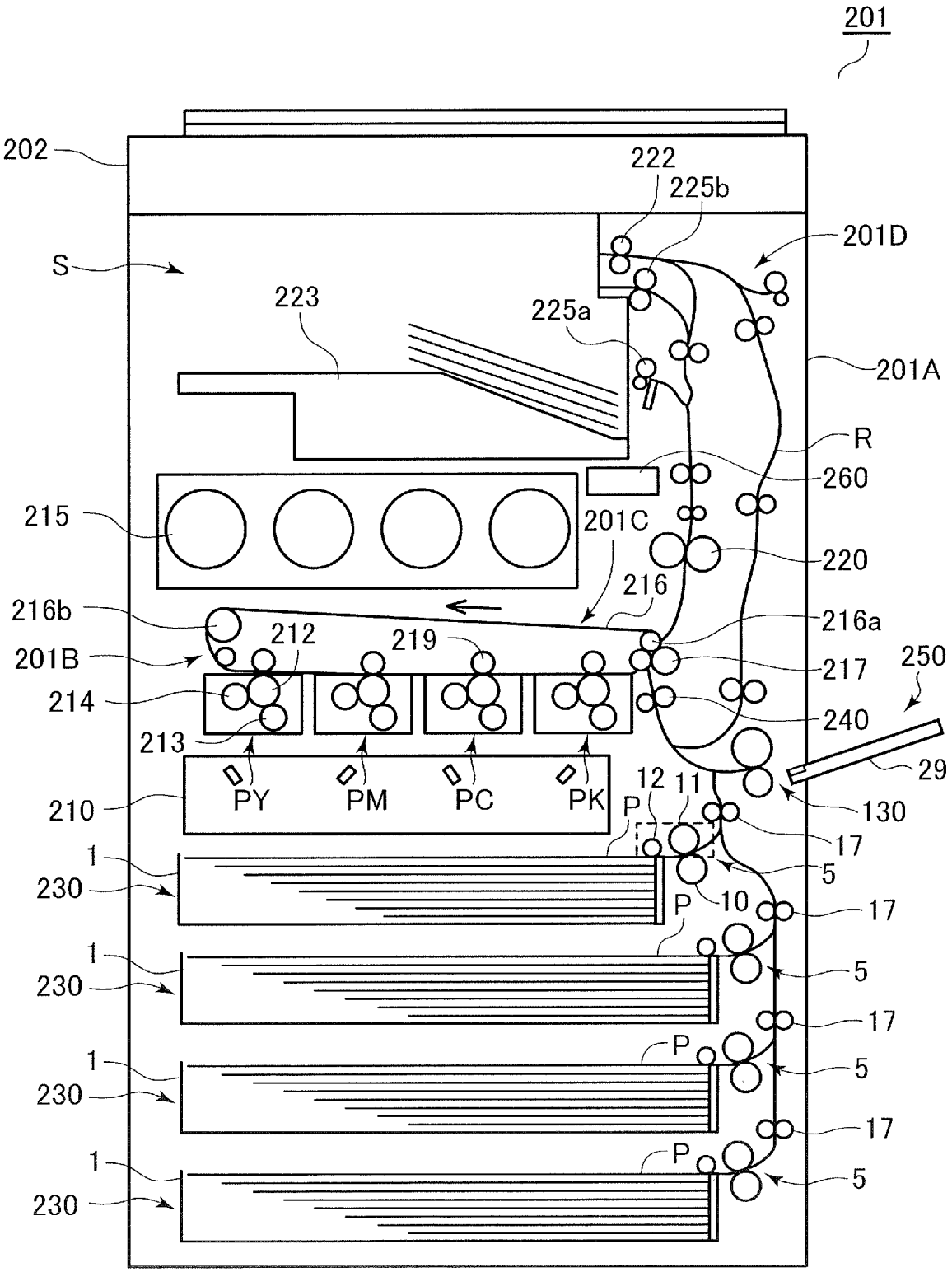
FIG. 1 is a schematic view of an image forming apparatus according to the present disclosure.

An image forming apparatus 201 according to the present disclosure is a laser printer equipped with an image forming unit 201B adopting an electrophotographic system, as illustrated in FIG. 1. An image reading apparatus 202 is disposed in an approximately horizontal posture and positioned above an image forming apparatus body (hereinafter simply referred to as apparatus body) 201A. A discharge space S to which sheets are discharged is formed between the image reading apparatus 202 and the apparatus body 201A.

At a lower portion of the apparatus body 201A is arranged a plurality of sheet feeding portions 230 each including a sheet feed cassette 1 storing sheets P and a sheet feed unit 5 for feeding sheets P from the sheet feed cassette 1. Each sheet feed unit 5 includes a pickup roller 12 that picks up and sends out the sheets P from the sheet feed cassette 1 and a feed roller 11 that receives the sheets P from the pickup roller 12 and feeds the sheets P. Further, the sheet feeding unit 5 includes a retard roller 10 that contacts the feed roller 11. The sheets P fed by the feed roller 11 are conveyed one by one in a state where the sheet P is separated from the other sheets by the retard roller 10 and conveyed by a conveyance roller pair 17 upward toward a registration roller pair 240. Further, on a side portion of the apparatus body 201A is arranged a manual sheet feeding portion 250 including a manual feed tray 29 that can be opened and closed with respect to the apparatus body 201A and a sheet feed unit 130 for feeding the sheet P supported on the manual feed tray 29.

The image forming unit 201B according to the present embodiment is a four-drum full-color electrophotographic unit. That is, the image forming unit 201B is equipped with a laser scanner 210 and four process cartridges PY, PM, PC and PK for forming toner images of four colors, which are yellow (Y), magenta (M), cyan (C) and black (K). Each of process cartridges PY through PK includes a photosensitive drum 212 serving as a photosensitive member, a charger 213 serving as a charging unit, and a developing unit 214 serving as a developing device. Further, the image forming unit 201B includes an intermediate transfer unit 201C arranged above the process cartridges PY through PK, and a fixing unit 220. Toner cartridges 215 for supplying toner to the developing units 214 are attached above the intermediate transfer unit 201C.

The intermediate transfer unit 201C includes an intermediate transfer belt 216 wound around a drive roller 216*a* and a tension roller 216*b*. On an inner side of the intermediate transfer belt 216 are provided primary transfer rollers 219 that contact the intermediate transfer belt 216 at positions opposed to the respective photosensitive drums 212. The intermediate transfer belt 216 is rotated in a counterclockwise direction in the drawing by the drive roller 216*a* that is driven by a driving unit not shown, and toner images having negative polarity borne on the photosensitive drums 212 are sequentially transferred in multilayers to the intermediate transfer belt 216 by the primary transfer rollers 219.

On the intermediate transfer unit 201C at a position opposed to the drive roller 216*a* is provided a secondary transfer roller 217 that transfers a color image borne on the intermediate transfer belt 216 to the sheet P. A fixing unit 220 is arranged above the secondary transfer roller 217, and above the fixing unit 220 are arranged a first discharge roller pair 225*a*, a second discharge roller pair 225*b* and a reversing portion 201D. The reversing portion 201D includes a reverse conveyance roller pair 222 capable of rotating in normal and reverse directions, and a re-conveyance passage R through which the sheet on which an image is formed on one side is conveyed to the image forming unit 201B again. Further, the image forming apparatus 201 is equipped with a control unit 260 serving as a controller for controlling image forming operations, sheet feeding operations and so on.

Next, an image forming operation of the image forming apparatus 201 will be described. Image information of a document is read by the image reading apparatus 202, subjected to image processing by the control unit 260, converted to electric signals and transmitted to the laser scanner 210 of the image forming unit 201B. In the image forming unit 201B, a laser beam from a laser scanner 210 is irradiated to the photosensitive drum 212 whose surface is uniformly charged to predetermined polarity and potential by a charger 213, and the surface of the drum is exposed while the drum rotates. Thus, on the surface of the photosensitive drums 212 in the respective process cartridges PY through PK are formed electrostatic latent images of single image colors of yellow, magenta, cyan and black. The electrostatic latent images are developed and visualized by respective color toners supplied from the developing units 214, and thereafter, primarily transferred from the photosensitive drums 212 to the intermediate transfer belt 216 in a mutually superposed manner by primary transfer bias applied to the primary transfer rollers 219.

Along with this operation, a sheet P is fed one by one from one of the sheet feeding portions 230 and 250 toward the registration roller pair 240. After correcting skewing of the sheet P, the registration roller pair 240 sends out the sheet P toward the secondary transfer roller 217 at a matched timing with the progress of the toner image forming operation by the image forming unit 201B. At a transfer portion, i.e., secondary transfer portion, formed between the secondary transfer roller 217 and the intermediate transfer belt 216, a full-color toner image is collectively secondarily transferred to the sheet P by secondary transfer bias applied to the secondary transfer roller 217. The sheet P on which the toner image has been transferred is conveyed to the fixing unit 220 and subjected to heat and pressure applied at the fixing unit 220, by which toner of respective colors is melted and mixed, and the toner image is fixed as color image to the sheet P.

Thereafter, the sheet P is discharged by the first discharge roller pair 225*a* or the second discharge roller pair 225*b* provided downstream of the fixing unit 220 to a discharge space S and stacked on a discharge portion 223 arranged at a bottom portion of the discharge space S. In order to form images on both sides of the sheet P, the sheet P having an image formed on a first surface is conveyed to the reconveyance passage R in a state reversed by the reverse conveyance roller pair 222, and then conveyed again to the image forming unit 201B. Then, an image is formed on the second surface of the sheet P by the image forming unit 201B, and the sheet P is discharged by the first discharge roller pair 225*a* or the second discharge roller pair 225*b* to the discharge portion 223.

The image forming unit 201B described above is merely an example of the image forming unit, and it is also possible to use a direct-transfer type electrophotographic unit in which the toner image formed on the photosensitive member is directly transferred to the sheet, or to use an image forming unit adopting an inkjet system or an offset printing system.

Jamming of Bulky Sheet

Figure 2A:
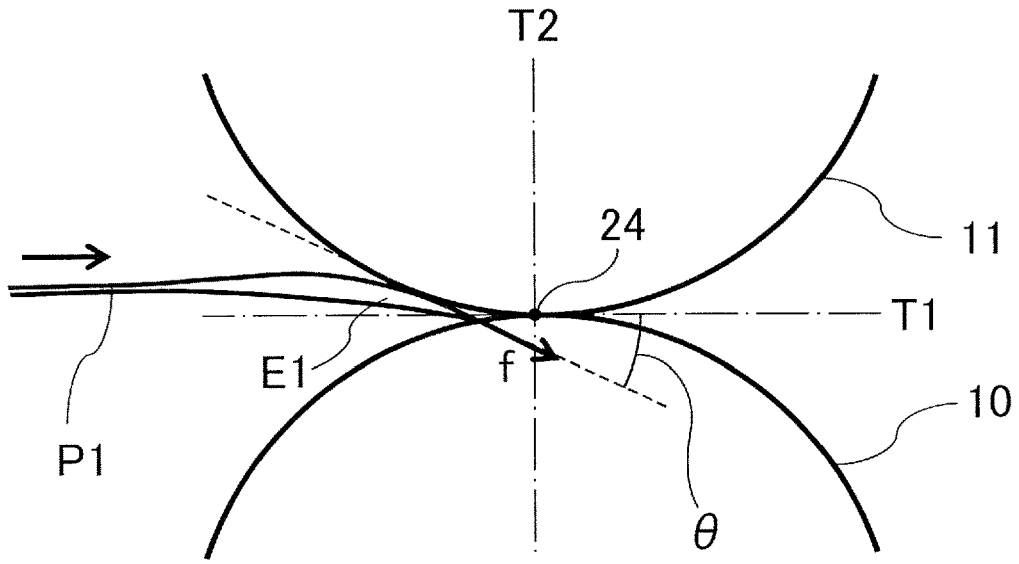
FIG. 2A is a simplified diagram illustrating sheet jamming of a bulky sheet.
Figure 2B:
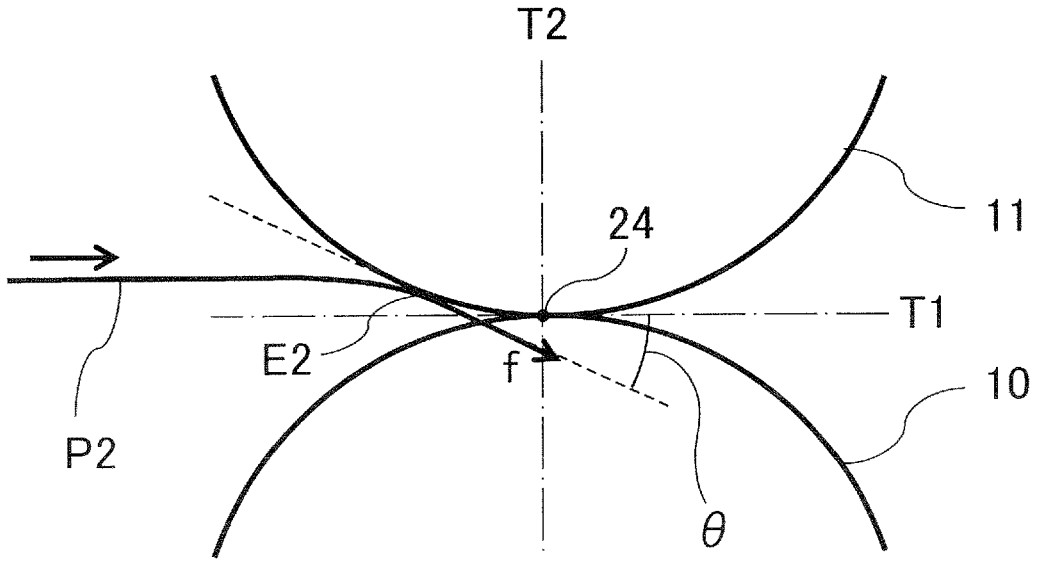
FIG. 2B is another diagram illustrating sheet jamming of a bulky sheet.

By the way, conventional sheet feeding apparatuses have to confront jamming of sheets in feeding bulky sheets that have bulkiness in the thickness direction thereof, such as envelopes, paper medicine bags or sheets that are curled, were conveyed. FIGS. 2A and 2B illustrate a state in which bulky sheets P1 and P2 are fed toward a separation nip 24 formed between the feed roller 11 and the retard roller 10 of the sheet feeding portion 230. The separation nip 24 refers to an area in which the feed roller 11 and the retard roller 10 contact each other, and in the drawing, it is illustrated as an intersection of a common tangent T1 of rollers 10 and 11 and a straight line T2 connecting axes of rollers 10 and 11 viewed from the axial direction of the two rollers 10 and 11.

As illustrated in FIG. 2A, the sheet P1 having a portion thereof folded back, such as an envelope or a paper medicine bag, has uneven thickness, and a leading edge E1, i.e., downstream end in the sheet feeding direction, may be bulked. Further, as illustrated in FIG. 2B, due to the storage condition of the sheet or by reasons such as having surface treatment applied to one surface of the sheet such as in the case of a coated paper, there may be a case where a leading edge E2 of the sheet P2 is curled. In such cases, if the leading edges E1 and E2 of the sheets P1 and P2 approach the separation nip 24 in a state where it is inclined with respect to a conveyance direction of the separation nip 24 (direction along the line T1), there were cases where the leading edges E1 and E2 could not pass through the separation nip 24 and sheet jamming had occurred.

The cause of sheet jamming may be explained as follows. In a state where angles θ of leading edges E1 and E2 of the sheets P1 and P2 are inclined toward the retard roller 10, the leading edges E1 and E2 contact the retard roller 10 at a position upstream of the separation nip 24. In this state, a part of force fin which the sheets P1 and P2 push the retard roller 10 acts in a direction perpendicular to a peripheral surface of the retard roller 10, and by this action, component of force acting in a direction along the peripheral surface of the retard roller 10 is reduced. Accordingly, compared to a case where the sheet is conveyed in a posture (θ=0) horizontal to the tangent T1, the force attempting to rotate the retard roller 10 transmitted through the sheet from the feed roller 11 is reduced, and it becomes difficult for the retard roller 10 to corotate with the feed roller 11. As a result, even if the feed roller 11 continues to rotate, the sheets P1 and P2 may stop movement in a state where the leading edges E1 and E2 are caught on the retard roller 10.

Therefore, in each of the embodiments described below, a configuration is provided to reduce sheet jamming in a case where sheets such as envelopes are fed, while ensuring the performance of separating the sheets.

First Embodiment

At first, a sheet feeding portion 230 according to a first embodiment is described with reference to FIGS. 3 through 8. FIG. 3 is a schematic view of the sheet feeding portion 230, wherein FIG. 3A illustrates a standby state prior to performing feeding operation, and FIG. 3B illustrates a state in which the sheet P is pushed up by a sheet support plate 3.

Figure 3A:
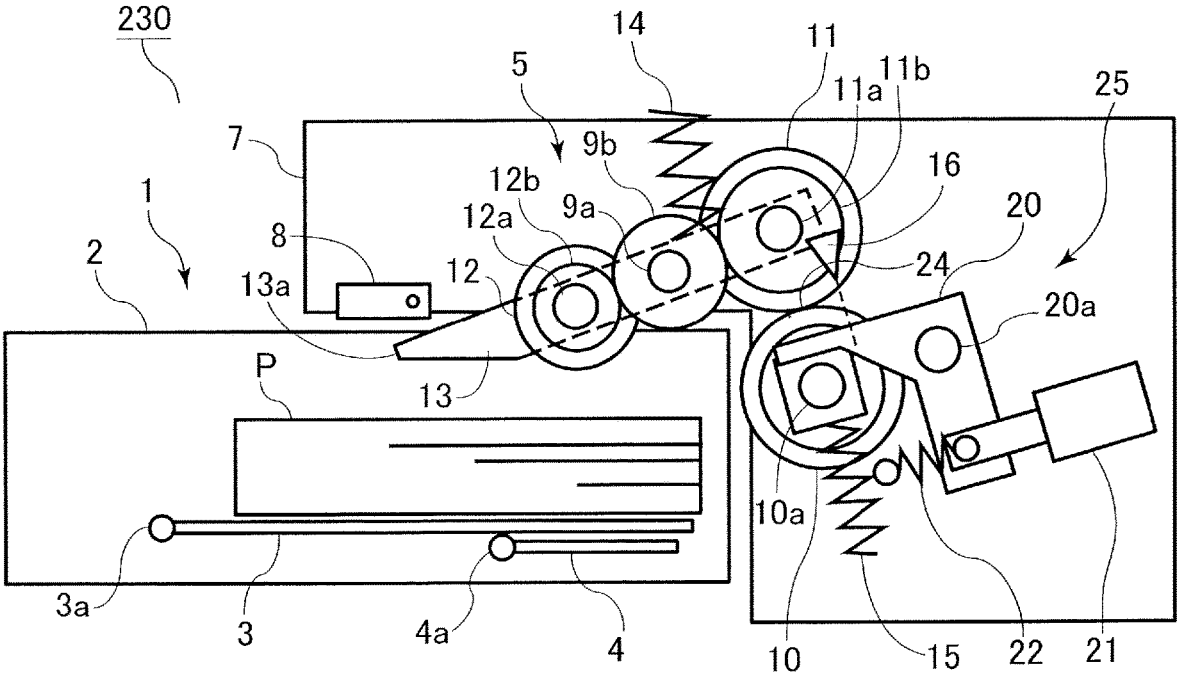
FIG. 3A is a schematic view of a sheet feeding unit according to a first embodiment.
Figure 3B:
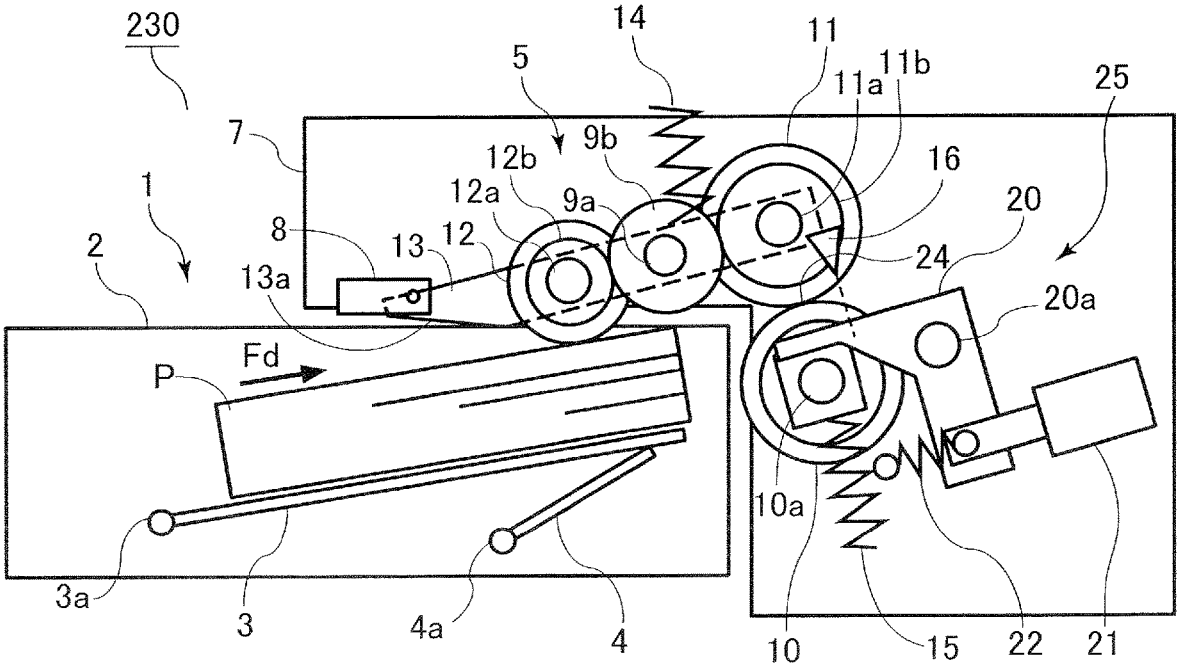
FIG. 3B is a schematic view of the sheet feeding unit according to the first embodiment

As illustrated in FIGS. 3A and 3B, the sheet feed cassette 1 is equipped with the sheet support plate 3 serving as a sheet supporting portion supporting the sheet P that can be lifted and lowered with respect to a bottom portion of a cassette body 2. The sheet support plate 3 is pivotable in a vertical direction, i.e., the gravity direction, around a pivot shaft 3*a*, and a lower surface thereof is supported by a lifter plate 4. The lifter plate 4 is driven by a lifter motor 26 described later and pivoted in the vertical direction around a lifter plate pivot shaft 4*a*, by which the sheet support plate 3 is lifted up and down. The sheet feed cassette 1 is capable of being inserted to and drawn out of the apparatus body 201A of the image forming apparatus 201 also serving as a casing of the sheet feeding apparatus in a direction perpendicular to a sheet surface of FIGS. 3A and 3B.

The sheet feed unit 5 is composed of the pickup roller 12 and the feed roller 11 that serves as a rotary feeding member. The retard roller 10 that engages with the feed roller 11 and a disengagement mechanism 25 thereof will be described in detail later. The pickup roller 12 is held rotatably by a pickup holder 13 serving as a holding member. The pickup holder 13 is pivotable, that is, movable in the vertical direction around a roller shaft 11*a* of the feed roller 11, and it is urged downward by a pickup spring 14 serving as an urging member. When no sheet is fed, the pickup holder 13 raises up the pickup roller 12 to a position separated from the sheet using an elevating mechanism not shown.

The feed roller 11 is attached to the roller shaft 11*a* and rotates by driving force transmitted to the roller shaft 11*a* from a sheet feed motor 27 described later. The roller shaft 11*a* has a first gear 11*b* attached thereto, and the pickup holder 13 has a rotation shaft 9*a* that supports a second gear 9*b* serving as an idler gear and a roller shaft 12*a* that supports a third gear 12*b* and the pickup roller 12. The rotation entered to the roller shaft 11*a* is transmitted from the first gear 11*b* through the second gear 9*b* to the third gear 12*b*. Thereby, the feed roller 11 and the pickup roller 12 are driven to rotate in a direction along a sheet feeding direction Fd, i.e., counterclockwise direction in the drawing. Further, the feed roller 11 and the pickup roller 12 are respectively connected to the roller shafts 11*a* and 12*a* through a one-way clutch, and are configured to rotate idly in a state where torque in an opposite direction as the sheet feeding direction Fd is received.

A flag portion 13*a* is provided on the pickup holder 13, and a sheet height sensor 8, such as a photoelectronic sensor, capable of detecting the flag portion 13*a* is provided on a sheet feed frame 7 fixed to the apparatus body 201A. By detecting the flag portion 13*a*, the sheet height sensor 8 determines whether an upper face of the sheet P supported on the sheet support plate 3 is at a predetermined position in the vertical direction. The predetermined position refers to a position at which the upper face of the sheet P contacts the pickup roller 12 with a pressure suitable for pickup operation (refer to FIG. 3B). Hereinafter, assuming that the sheet height sensor 8 is a photoelectronic sensor, the state in which the flag portion 13*a* shades the sheet height sensor 8 is referred to as an on state of the sensor and the state in which the flag portion 13*a* does not shade the sensor is referred to as an off state.

The retard roller 10 serving as a separation member is mounted to a retard roller shaft 10*a* through a torque limiter not shown, and driving force in a direction opposite from the corotating direction with the feed roller 11 (i.e., in a direction opposite from one in which the roller surface of the retard roller 10 moves in the sheet feeding direction Fd at the separation nip) is entered from the sheet feed motor 27 common to the sheet feed unit 5. The retard roller 10 is in pressure contact with the feed roller 11 by a retard spring 15 serving as an urging member, forming the separation nip 24 serving as a separation portion for separating the sheet P with the feed roller 11. If only one sheet P exists in the separation nip 24, the sheet P is moved in the sheet feeding direction Fd by conveyance force received from the feed roller 11 and the pickup roller 12, and the retard roller 10 corotates with the rotation of the feed roller 11 by the slipping of the torque limiter. Meanwhile, if a plurality of sheets P exists in the separation nip 24, the retard roller 10 rotates in an opposite direction, i.e., a rotation direction against the sheet feeding direction Fd, by driving force received through the torque limiter, and pushes the sheets P other than the uppermost sheet P toward an upstream side in the sheet feeding direction Fd.

In a vicinity of the separation nip 24 is provided a nip sensor 16 that detects the sheet P at a detection position downstream of the separation nip 24 in the sheet feeding direction Fd. The nip sensor 16 which is an example of a sheet sensor is a reflection-type photoelectronic sensor that projects a laser beam to a conveyance path of the sheet P and detects reflected light from the sheet P, for example. Hereafter, a state in which the sheet P is present in the detection position and the nip sensor 16 detects reflected light from the sheet P is referred to as an on state, and a state in which the sheet P is not present in the detection position and no reflected light is detected is referred to as an off state.

Disengagement Mechanism

In order to feed bulky sheets, it is effective to separate (or, disengage) the feed roller 11 and the retard roller 10 to be apart from each other in advance so that the separation nip 24 is open. As described earlier, when feeding bulky sheets (refer to FIGS. 2A and 2B), the leading edges E1 and E2 of the sheets P1 and P2 may be caught on the retard roller 10 at a position upstream of the separation nip 24 and may not pass through the separation nip 24. By opening the separation nip 24, the position at which the leading edges E1 and E2 of the sheet come into contact with the retard roller 10 is shifted downstream in the sheet feeding direction, so that the retard roller 10 can easily corotate with the feed roller 11, and the possibility of sheet jam can be reduced.

The retard roller 10 driven in an opposite rotation direction from a direction of corotation with the feed roller 11 is one example of a separation member that separates the sheet by frictional force, and it is also possible to use a roller member connected to a shaft fixed to the apparatus body through a torque limiter or a pad member as the separation member. Even according to these cases, the sheet can easily pass through the separation nip by separating the separation member from the feed roller 11, so that the possibility of sheet jamming can be reduced.

The disengagement mechanism 25 according to the present embodiment will be described with reference to FIGS. 4A and 4B. The disengagement mechanism 25 is composed of a disengagement arm 20, a solenoid 21 and a release spring 22. The disengagement arm 20 serving as a swing member is supported via an arm pivot shaft 20*a* by the sheet feed frame 7, and can be engaged with a bearing member of the retard roller shaft 10*a*. The release spring 22 is connected to the solenoid 21 and urges a plunger of the solenoid 21 toward a neutral position (position of FIG. 4A).

Figure 4A:
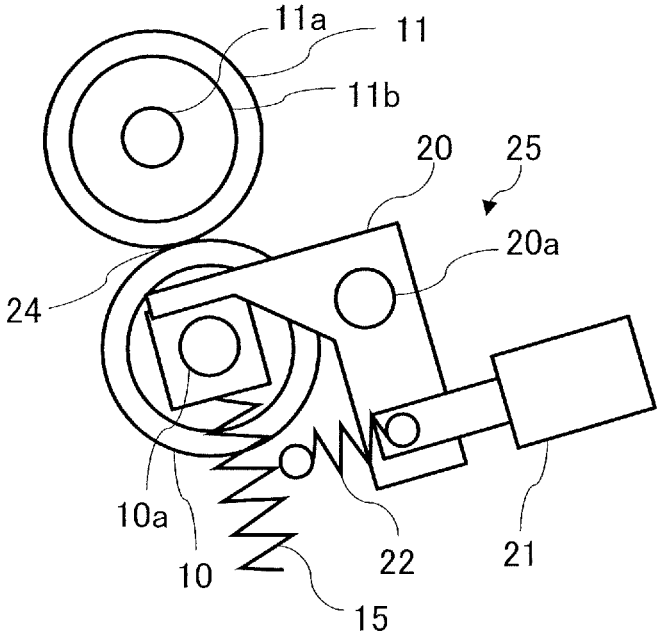
FIG. 4A is a schematic view illustrating a configuration and operation of a disengagement mechanism according to the first embodiment.
Figure 4B:
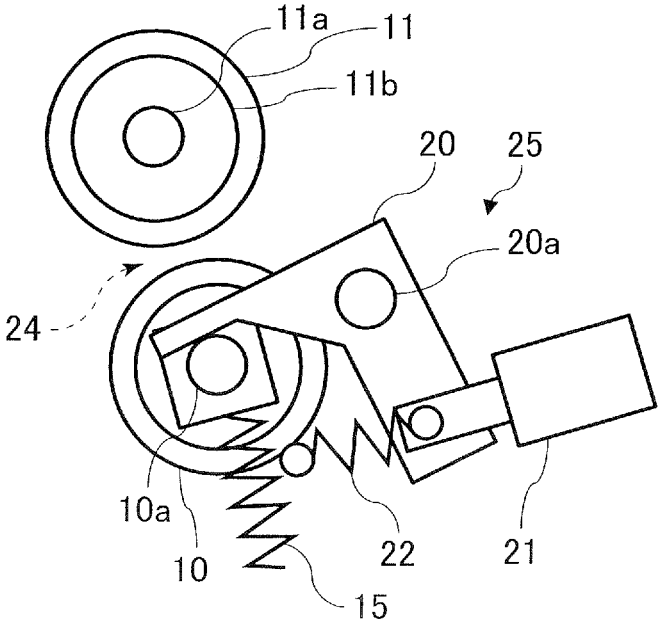
FIG. 4B is a schematic view illustrating the configuration and operation of the disengagement mechanism according to the first embodiment.

As illustrated in FIG. 4A, when the solenoid 21 is in an off state, i.e., deactivated, the retard roller shaft 10*a* is urged toward the feed roller 11 by the retard spring 15, bringing the feed roller 11 and the retard roller 10 into a pressure-contact. As illustrated in FIG. 4B, when the solenoid 21 is in an on state, i.e., activated, the disengagement arm 20 swings against the urging force of the retard spring 15 and presses a roller shaft 10*a* of the retard roller 10. Thereby, the retard roller 10 is separated from the feed roller 11, and the separation nip 24 (refer to FIG. 4A) is released. The disengagement mechanism 25 is an example of a disengagement mechanism capable of separating (or, disengaging) the rotary feeding member and the separation member to be apart from each other, and it is also possible to adopt a disengagement mechanism having a configuration that differs from the above-described disengagement mechanism 25. For example, a configuration can be adopted in which a shaft position of the retard roller 10 is fixed and the feed roller 11 is moved.

Hereafter, the state in which the feed roller 11 and the retard roller 10 are in contact with each other (FIG. 4A) is referred to as an engaged state of the separation nip 24, and the state in which the feed roller 11 and the retard roller 10 are separated (FIG. 4B) is referred to as a disengaged state, i.e., opened state, of the separation nip 24. The distance between the retard roller 10 and the feed roller 11 in the disengaged state is set to a value equal to or greater than a thickness of one envelope or one paper medicine bag, which is 0.5 to 2 millimeters, for example.

Figure 5:
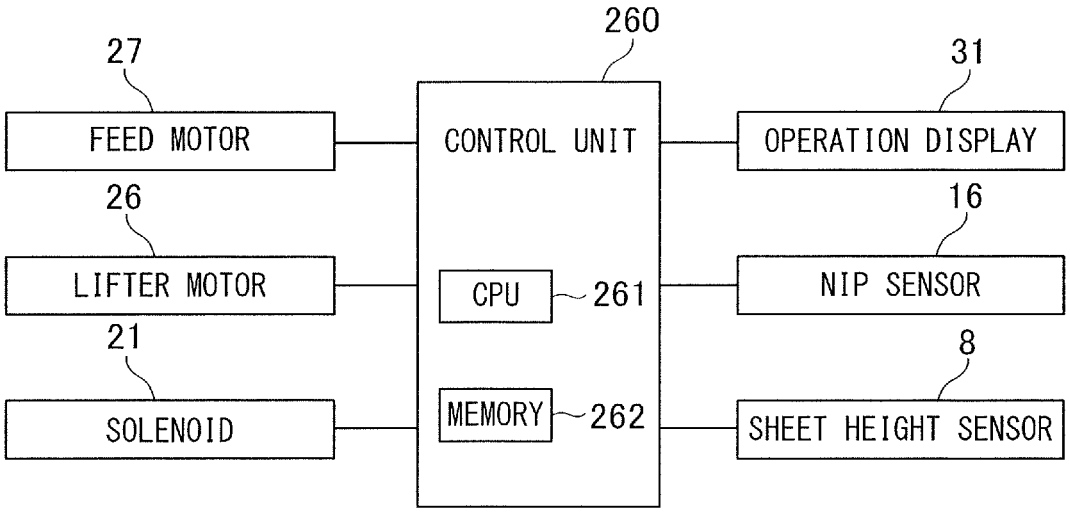
FIG. 5 is a block diagram illustrating a control configuration of a sheet feeding unit according to the first embodiment.

A control configuration of the sheet feeding portion 230 will now be described. The sheet feeding portion 230 is controlled by the control unit 260 (refer to FIG. 1) installed in the apparatus body 201A of the image forming apparatus 201. As illustrated in FIG. 5, the control unit 260 includes a central processing unit (CPU) 261 serving as a processor capable of executing programs, and a memory 262 serving as a storage unit configured to store programs and data such as setting information. The control unit 260 is connected to an operation display 31, such as a liquid crystal display, in addition to the above-described sheet feed motor 27, lifter motor 26, solenoid 21, sheet height sensor 8 and nip sensor 16. The operation display 31, which serves as an input portion through which a sheet type is input, displays a screen which shows candidates of sheet type such as plain paper, thick paper and envelope and through which the user is enabled to select the sheet types of the sheets set in the respective sheet feed cassettes 1 and the manual feed tray 29. The operation display 31 receives selection operation of the user. Based on the operation of the user through the operation display 31, the control unit 260 stores the sheet type information in the memory 262 while associating the same with either one of the sheet feed cassettes 1 and the manual feed tray 29.

Method for Detecting Bulky Sheet

It is important for the leading edge of the sheet to pass through the separation nip 24 in a state where the separation nip 24 is opened in order to prevent conveyance failure of a bulky sheet, but if the separation nip 24 is always opened, multiple feeding of the sheer may occur. That is, if sheets that are not bulky, such as plain paper, are fed, the sheets cannot be sufficiently separated by the retard roller 10, and the sheets may reach the conveyance member downstream of the separation nip 24 in a state where a plurality of sheets are superposed.

According to the present embodiment, a configuration is adopted in which bulkiness of the sheet is determined based on whether the pickup roller 12 sinks when the sheet feed unit 5 is driven by the sheet feed motor 27, and modes of the feeding operation are switched based on the determination result.

In a state where the sheet P is conveyed, prior to starting drive of the sheet feed unit 5 by the sheet feed motor 27, the sheet support plate 3 is lifted to a position where the sheet height sensor 8 is switched in the on state (refer to FIG. 3B). As described, in a state where driving force is entered from the sheet feed motor to the roller shaft 11*a* of the feed roller 11, the pickup roller 12 is urged downward by the force caused by the pushing of tooth faces of the gears, independently from the urging force of the pickup spring 14.

Figure 6:
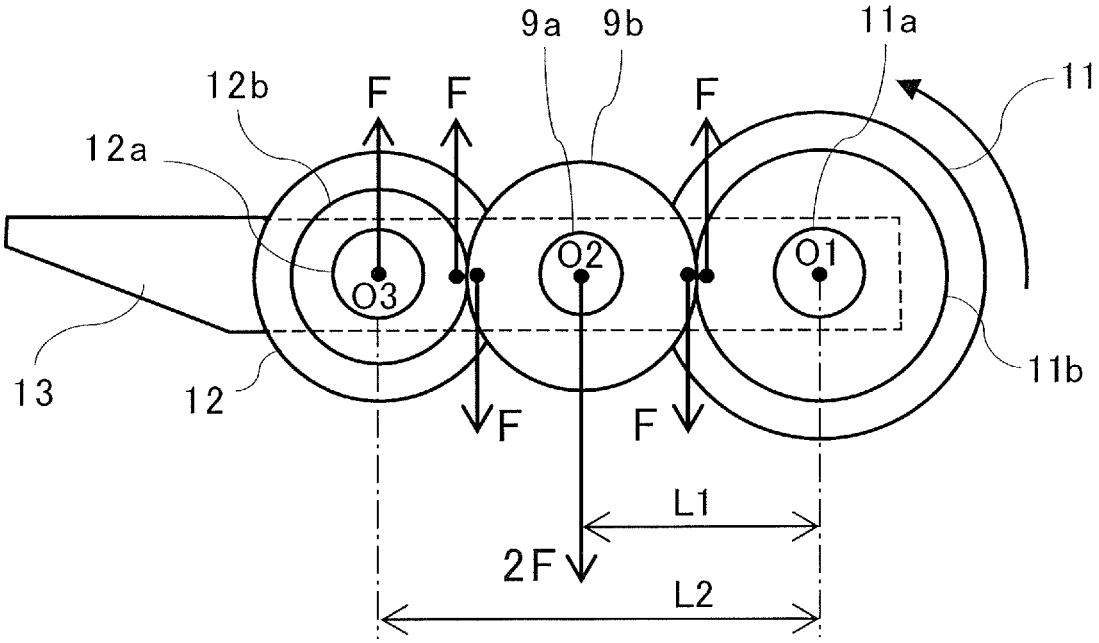
FIG. 6 is a simplified diagram illustrating forces acting on a pickup holder according to the first embodiment.

FIG. 6 is a simplified diagram of the sheet feed unit 5 viewed from an axial direction of the roller shaft 11*a* of the feed roller 11. Rotational axes of the first gear 11*b*, the second gear 9*b* and the third gear 12*b* constituting a gear train of the present embodiment are referred to as O1, O2 and O3, inter-axis distance of the first gear 11*b* and the second gear 9*b* is referred to as L1, and inter-axis distance of the first gear 11*b* and the third gear 12*b* is referred to as L2. Axial positions of the respective gears are arranged such that a relationship of 2×L1>L2 is satisfied.

In a state where the first gear 11*b* is rotated in the counterclockwise direction in the drawing by driving force from the sheet feed motor 27, the second gear 9*b* serving as an idler gear is rotated in a clockwise direction and the third gear 12*b* is rotated in the counterclockwise direction. In this state, at meshing faces of the first gear 11*b* and the second gear 9*b*, the second gear 9*b* is pressed downward by force F as an action, and the first gear 11*b* is pushed back upward by force F as a reaction. Further, at meshing faces of the second gear 9*b* and the third gear 12*b*, the third gear 12*b* is pushed upward by force F as an action, and the second gear 9*b* is pushed back downward by force F as a reaction.

Based on balance of moment, it can be assumed that downward force of 2×F acts on the rotation shaft 9*a* of the second gear 9*b* and upward force of F acts on the roller shaft 12*a* of the pickup roller 12. Therefore, the pickup holder 13 receives action of the following moment M centered on the roller shaft 11*a* of the feed roller 11, with the counterclockwise direction referred to as positive direction.

$$M=2\times F\times L1-F\times L2=F(2\times L1-L2)$$

Here, a configuration is adopted in which positions of rotational axes O1 through O3 of the respective gears are set to 2×L1>L2, the moment M applied on the pickup holder 13 satisfies M>0. Then, since the pickup holder 13 attempts to pivot in the counterclockwise direction in the drawing, the force in which the pickup roller 12 presses the upper face of the sheet P is increased. A configuration in which axes O1, O2 and O3 of respective gears 9*b*, 11*b* and 12*b* are aligned linearly is illustrated in the drawing, but a similar result is achieved as long as the above-described relationship of moments in the pivoting direction of the pickup holder 13 is satisfied. That is, any configuration can be adopted as long as a downward moment acts on the pickup holder 13 through the gear train when a sheet feed motor 27 serving as the driving source drives the pickup roller 12.

Figure 7A:
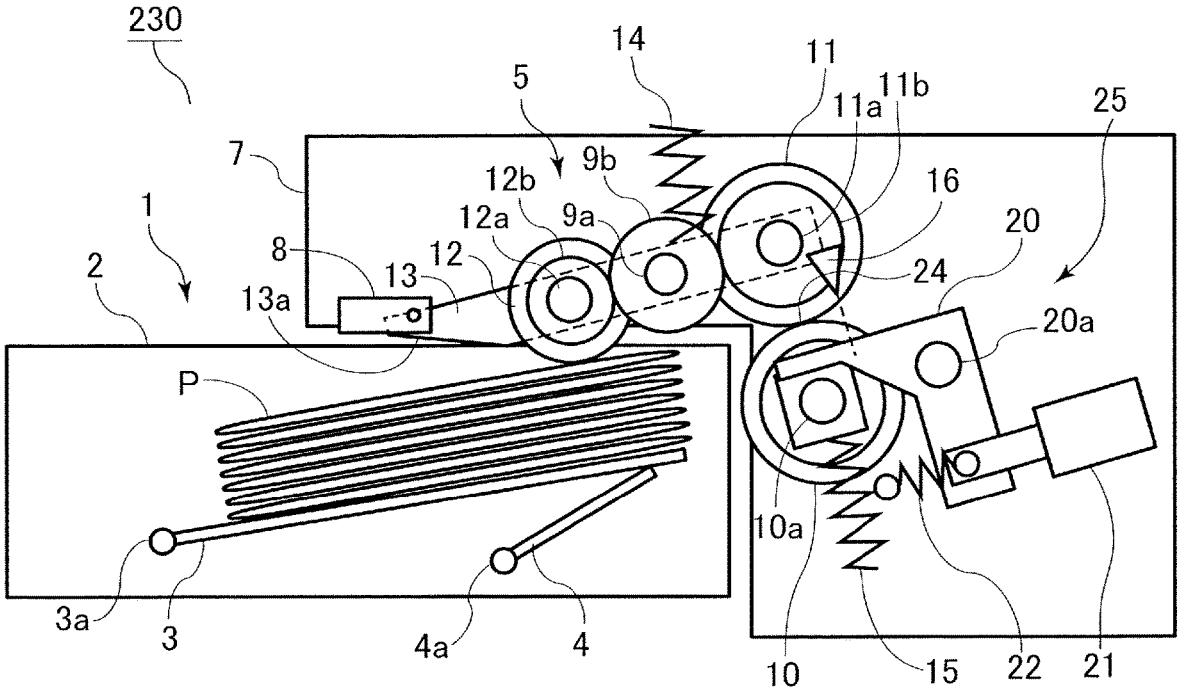
FIG. 7A is a schematic view of the sheet feeding unit for explaining how bulkiness of a sheet is detected according to the first embodiment.
Figure 7B:
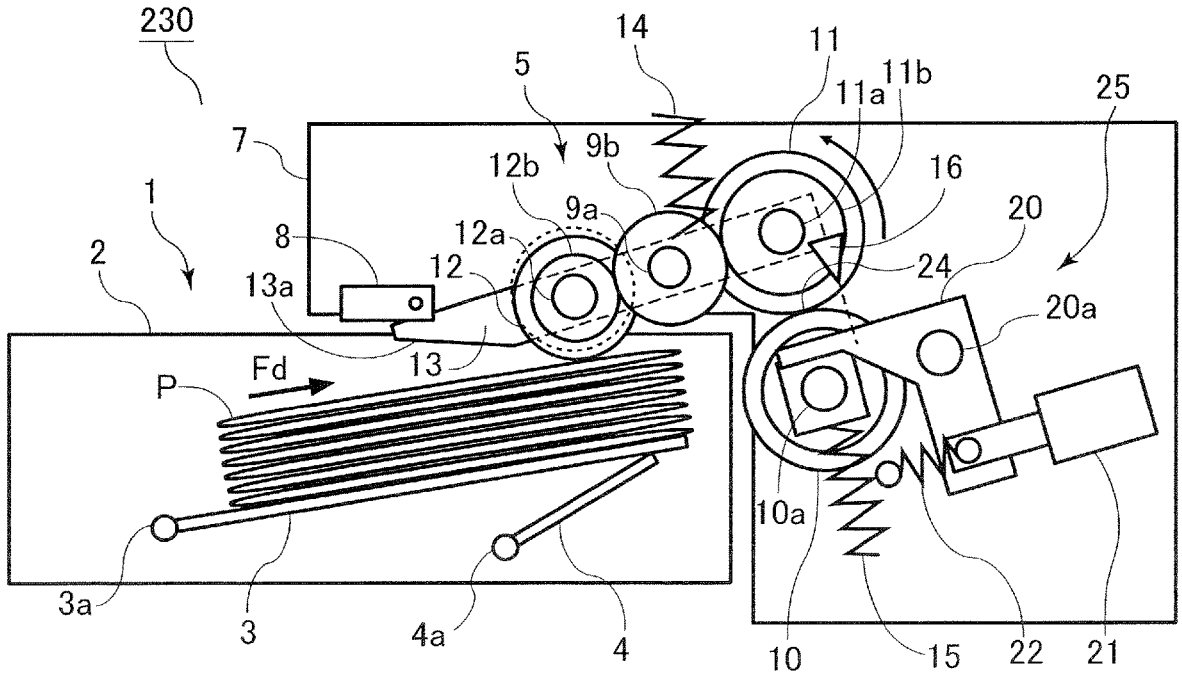
FIG. 7B is another schematic view of the sheet feeding unit for explaining how bulkiness of the sheet is detected according to the first embodiment.

According to the above-described configuration, if the sheet P has bulkiness, such as an envelope, a paper medicine bag or a curled sheet, as illustrated in FIG. 7A, pressing force of the pickup roller 12 increases along with the starting of drive of the sheet feed motor 27. Then, the upper face of the sheet P is pressed by the pickup roller 12 and sinks downward, as illustrated in FIG. 7B. In this state, if the flag portion 13*a* provided on the pickup holder 13 moves out of the detection range of the sheet height sensor 8, the sheet height sensor 8 is switched from on state to off state. Thus, it becomes possible to detect whether the sheet P supported on the sheet support plate 3 is bulky.

Method for Controlling Feeding Operation

A method for controlling a feeding operation of sheets by the sheet feeding portion 230 using such detecting mechanism will be described with reference to the flowchart of FIG. 8. The respective steps of the flowchart are realized by a CPU 261 of the control unit 260 (refer to FIG. 5) that reads out and executes a program stored in the memory 262.

If a user places the sheet P on the sheet support plate 3 and attaches the sheet feed cassette 1 to the apparatus body 201A, a sensor provided on the apparatus body 201A detects attachment of the sheet feed cassette 1. Then, the CPU 261 rotates the lifter motor 26 and starts lifting of the sheet support plate 3 (S1). If the sheet support plate 3 is lifted to a position where the sheet height sensor 8 is turned on (S2: Yes), the CPU 261 stops the lifter motor 26 (S3) and stands-by until the sheet feeding operation is started. In the standby state, the retard roller 10 is kept in pressure contact with the feed roller 11.

If a signal that instructs output of image, i.e., image forming job, is entered from an external PC to the image forming apparatus 201, or if a user sets a document on the image reading apparatus 202 (refer to FIG. 2) and pushes a copy button or the like, the feeding operation is started (S4: Yes). In this case, the CPU 261 performs control to start rotation of the sheet feed motor 27 to feed a first sheet (S5), and determines whether the feed target sheet (i.e., the sheet to be fed) has bulkiness based on the detection signal of the sheet height sensor 8 (S6).

If a flat sheet such as plain paper is supported on the sheet support plate 3, the upper face of the sheet would not sink down even if the pickup roller 12 is urged downward by the driving force of the sheet feed motor 27, and the sheet height sensor 8 maintains an on state. In that case, the CPU 261 determines that the feed target sheet is not bulky (S6: No), and continues rotation of the sheet feed motor 27 to feed the sheet by the sheet feed unit 5 without changing the state of the disengagement mechanism 25. Then, if it is determined that a sheet has reached a conveyance roller pair (such as the conveyance roller pair 17 of FIG. 2) downstream of the separation nip 24 (S14: Yes), the CPU 261 stops the sheet feed motor 27 (S15). The timing at which the sheet reaches the conveyance roller pair on the downstream side can be determined, for example, by a sensor arranged near the conveyance roller pair, or by a combination of a detection timing of the sheet by the nip sensor 16 and a conveyance speed of sheet (i.e., peripheral speed of the feed roller 11) by the sheet feed unit 5. In order to feed a second sheet (S16: No), the rotation of the sheet feed motor 27 is started again (S17), and similar feeding operation (S14 through S16) is repeatedly performed until the necessary number of sheets are fed.

Meanwhile, during feeding of the first sheet, if the sheet height sensor 8 is turned from on state to off state after starting rotation of the sheet feed motor 27, the CPU 261 determines that the feed target sheet is bulky (S6: Yes). In that case, by activating the solenoid 21 of the disengagement mechanism 25 while the rotation of the sheet feed motor 27 is continued, the retard roller 10 is separated from the feed roller 11 and the separation nip 24 is opened (S7). The sheet enters the separation nip 24 in the disengaged state mainly by the conveyance force received from the pickup roller 12.

If it is detected that the leading edge of the sheet has passed through the separation nip 24 by the nip sensor 16 turning from off to on (S8: Yes), the CPU 261 ends activation of the solenoid 21 and controls the retard roller 10 to contact the feed roller 11 (S9). Thereby, a state in which the sheet is nipped by the feed roller 11 and the retard roller 10 at the separation nip 24 is realized. Then, while the sheet receives conveyance force from both the pickup roller 12 and the feed roller 11 and is conveyed toward the image forming unit 201B, the sheet superposed below the sheet being fed is pushed back toward the upstream side of the sheet feeding direction by the retard roller 10.

Thereafter, if it is determined that the sheet has reached the conveyance roller pair downstream of the separation nip 24 (S10: Yes), the CPU 261 stops the sheet feed motor 27 (S11). If a second sheet is to be fed (S12: No), the rotation of the sheet feed motor 27 is started again (S13), and similar feeding operation (S7 through S12) is repeatedly performed until the necessary number of sheets is fed. In this case, since it is already determined that the sheet is bulky, the second and subsequent sheets are fed in a state where the separation nip 24 is opened by the disengagement mechanism 25, and thereafter, an operation to set the separation nip 24 to an engaged state (S7 through S9) is performed.

As described, according to the present embodiment, the sheet height sensor 8 is used to detect the displacement of the sheet when the pickup roller 12 serving as a pressing portion presses the upper surface of the sheet, and control is performed to switch the contents of the feeding operation performed by the sheet feeding portion 230 based on the detection result. In other words, whether to execute the first feed mode (S7 through S13) or the second feed mode (S14 through S17) is determined based on the detection result of the sheet height sensor 8 serving as the detector.

In the first feed mode, operation of the disengagement mechanism 25 is controlled so that the leading edge of the sheet passes the position of the separation nip 24 in a state where the separation nip 24 serving as the separation portion is opened. Thereby, the possibility of conveyance failure of the sheet that is bulky, such as an envelope or a paper medicine bag, and has a large resistance when entering the separation nip 24, is reduced. Meanwhile, in the second feed mode, in a state where the separation nip 24 is maintained in the engaged state, the leading edge of the sheet passes the separation nip 24 in the engaged state. Thereby, the occurrence of multiple feeding can be prevented for sheets that are not bulky, such as plain paper. According to the configuration of the present embodiment, the occurrence of conveyance failure of the bulky sheet such as an envelope can be reduced while minimizing the possibility of multiple feeding of sheets.

According to the present embodiment, a pressing portion capable of pressing the upper face of the sheet is configured as a portion of the sheet feed unit 5, that is, the pickup roller 12, and it is designed to move downward along with the driving of the feed roller 11 serving as the rotary feeding member. Therefore, the configuration for feeding the sheet can also be used as a configuration for detecting bulkiness of the sheet.

Modified Example

In the above-described first embodiment, the sheet sent out from the sheet support plate 3 by the pickup roller 12 is fed through the separation nip 24 formed between the feed roller 11 and the retard roller 10, but a sheet feed unit that adopts a different configuration can be used. For example, it is possible to use a belt member as a rotary feeding member and separate the sheets by a retard roller that contacts the belt member. Further, the sheet feed unit is not restricted to those equipped with the pickup roller 12, and a configuration can be adopted in which the feed roller 11 directly contacts the sheet supported on the sheet support plate 3 and feeds the sheet. In that case, in a state where the feed roller 11 is driven, a member that presses the upper face of the sheet can be provided as the pressing portion instead of the pickup roller 12.

Second Embodiment

Next, a sheet feeding apparatus according to a second embodiment will be described with reference to FIG. 9. The sheet feeding apparatus according to the present embodiment differs from the first embodiment described above in that a feeding operation is controlled based on a sheet type entered through an input portion such as the operation display 31 described above (refer to FIG. 5). Other elements having an equivalent configuration and operation as those of the first embodiment are denoted with the same reference numbers as the first embodiment and descriptions thereof are omitted.

Figure 9:
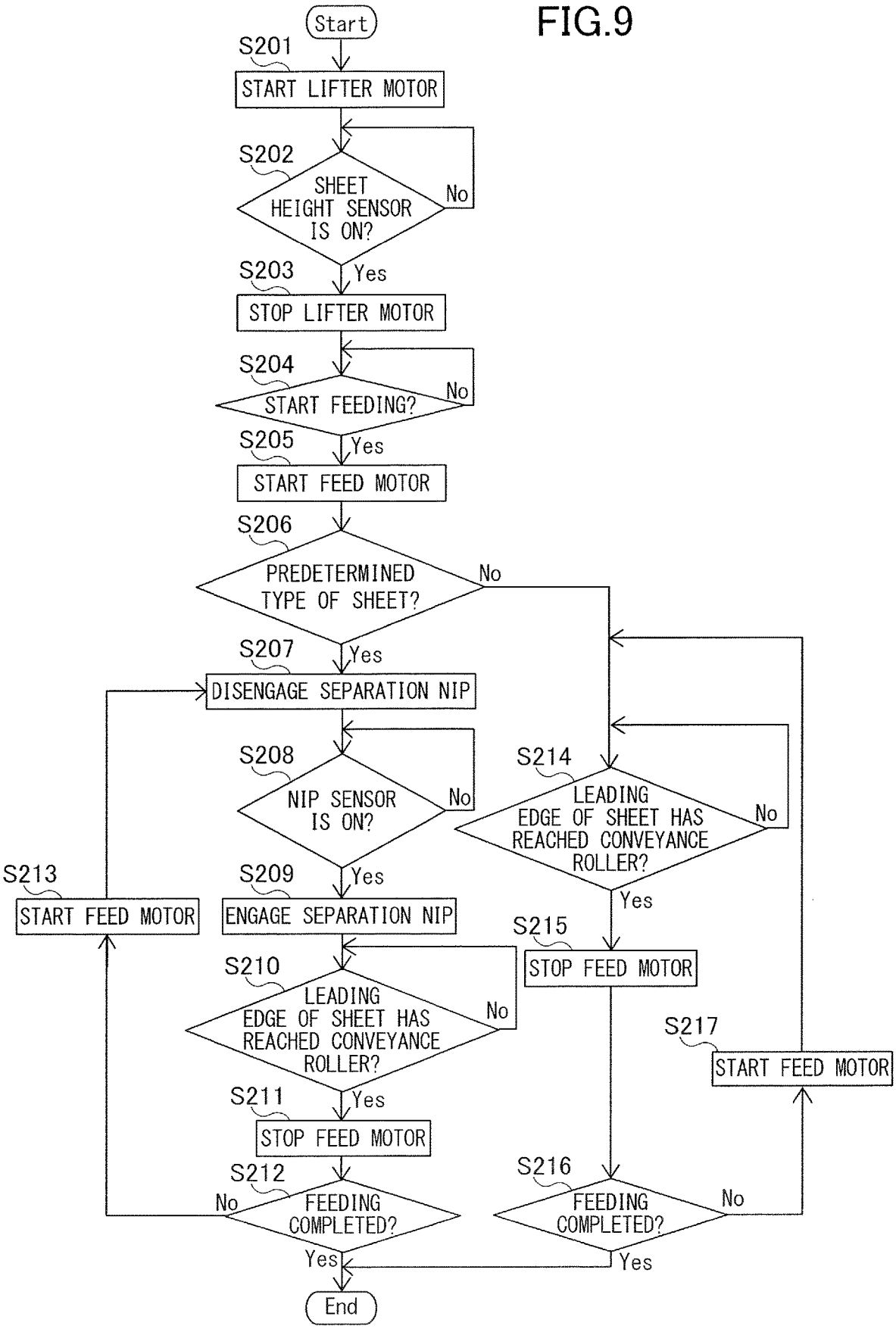
FIG. 9 is a flowchart illustrating a method for controlling a feeding operation according to a second embodiment.

As illustrated in step S206 of FIG. 9, according to the present embodiment, a configuration is adopted in which the first feed mode is executed, based on the information set up as the type of sheet supported on the sheet support plate 3, if the sheets to be fed is are a predetermined sheet type that is determined in advance. The predetermined sheet type refers to a sheet having a large resistance when it enters the separation nip 24 in the engaged state, and may be envelopes, paper medicine bags, an embossed paper whose surface is subjected to embossing treatment, and/or a coated paper whose one surface is subjected to resin coating. These sheet types are stored in the memory 262 (FIG. 5) of the control unit 260 as settings related to the respective sheet feed cassettes 1 (that is, as settings related to each sheet supporting portion) provided in the image forming apparatus 201, and referred to by the CPU 261 during execution of a program. It is also possible to adopt a configuration in which the sheet type to which the first feed mode is executed is explicitly selected by the user using the operation display 31, and the CPU 261 rewrites the sheet type stored in the memory 262 according to the result of selection.

Now, a method for controlling the feeding operation according to the present embodiment will be described with reference to the flowchart of FIG. 9. It is assumed that the information on the sheet type supported on the sheet support plate 3 is set in advance prior to starting the feeding operation, including a case where the control unit 260 automatically selects the initial value.

In a state where the user places the sheet P on the sheet support plate 3 and attaches the sheet feed cassette 1 to the apparatus body 201A, the sensor provided on the apparatus body 201A detects attachment of the sheet feed cassette 1. Then, the CPU 261 rotates the lifter motor 26 and starts lifting the sheet support plate 3 (S201). If the sheet support plate 3 is lifted to a position where the sheet height sensor 8 is turned on (S202: Yes), the CPU 261 stops the lifter motor 26 (S203) and stands-by until the sheet feeding operation is started. In the standby state, the retard roller 10 is kept in pressure contact with the feed roller 11.

When a feeding operation is started (S204: Yes), the CPU 261 starts rotation of the sheet feed motor 27 to feed the first sheet (S205). Then, the CPU 261 determines whether the sheet type set up for the sheet feed cassette 1 or the manual feed tray 29 (refer to FIG. 2) selected as source from which the sheet is fed is a predetermined type (S206).

If the feed target sheet is not a predetermined sheet types type (S206: No), that is, if the sheet is a normal sheet without bulkiness, the CPU 261 continues rotation of the sheet feed motor 27 without changing the state of the disengagement mechanism 25 and feeds the sheet to the sheet feed unit 5. Then, when it is determined that the sheet has reached the conveyance roller pair downstream of the separation nip 24 (S214: Yes), the CPU 261 stops the sheet feed motor 27 (S215). If a second sheet is to be fed (S216: No), the rotation of the sheet feed motor 27 is started again (S217), and the similar feeding operation (S214 through S216) is repeatedly performed until the necessary number of sheets is fed.

Meanwhile, if the feed target sheet is a predetermined sheet type (S206: Yes), that is, if the sheet is bulky, the CPU 261 activates the disengagement mechanism 25 while the rotation of the sheet feed motor 27 is continued, and opens the separation nip 24 (S207). The sheet enters the separation nip 24 in the disengaged state mainly by the conveyance force received from the pickup roller 12.

Then, if it is detected that the leading edge of the sheet has passed through the separation nip 24 by the nip sensor 16 turning from off to on (S208: Yes), the CPU 261 cancels activation of the disengagement mechanism 25 (S209). Thereby, the retard roller 10 contacts the feed roller 11, and the sheet is nipped by the feed roller 11 and the retard roller 10 at the separation nip 24. Then, while the sheet receives conveyance force from both the pickup roller 12 and the feed roller 11 and is conveyed toward the image forming unit 201B, the sheet superposed under the sheet being conveyed is pushed back toward the upstream side in the sheet feeding direction by the retard roller 10.

Thereafter, if it is determined that the sheet has reached the conveyance roller pair on the downstream side by the separation nip 24 (S210: Yes), the CPU 261 stops the sheet feed motor 27 (S211). If a second sheet is to be fed (S212: No), the rotation of the sheet feed motor 27 is started again (S213), and a similar feeding operation (S207 through S212) is repeatedly performed until the necessary number of sheets is fed. In this case, it is already determined that the sheet is a predetermined sheet type. Therefore, while feeding the second and subsequent sheets, the sheets are fed in a state where the separation nip 24 is opened by the disengagement mechanism 25, and thereafter, an operation to set the separation nip 24 to the engaged state (S207 through S209) is performed.

As described, according to the present embodiment a control to switch the contents of the feeding operation performed by the sheet feeding portion 230 based on the sheet type supported on the sheet support plate 3 is performed. In other words, whether to execute the first feed mode (S207 through S213) or the second feed mode (S214 through S217) is determined based on the sheet type entered through the input portion, i.e., the operation display 31.

Similar to the first embodiment, in the first feed mode, the operation of the disengagement mechanism 25 is controlled so that the leading edge of the sheet passes the position of the separation nip 24 serving as the separation portion in a state where the separation nip 24 is opened. Thereby, the possibility of occurrence of conveyance failure of the sheet such as an envelope or a paper medicine bag can be reduced. Meanwhile, in the second feed mode, the leading edge of the sheet passes the separation nip 24 in the engaged state in a state where the separation nip 24 is maintained in the engaged state. Thereby, occurrence of multiple feeding can be prevented for sheets that are not bulky, such as plain paper. Therefore, according to the configuration of the present embodiment, it becomes possible to reduce the possibility of sheets such as envelopes being jammed while minimizing the possibility of occurrence of multiple feeding of the sheets.

According further to the present embodiment, a configuration is adopted in which the feed mode is switched based on whether the setting information of the sheet type is included in the predetermined types of sheets, so that if the setting information is the same, the same feed mode is selected. Therefore, a sheet feeding apparatus that exhibits stable behavior regardless of causes such as the number of supported sheets or the stiffness of the sheets can be provided.

Third Embodiment

Figure 10:
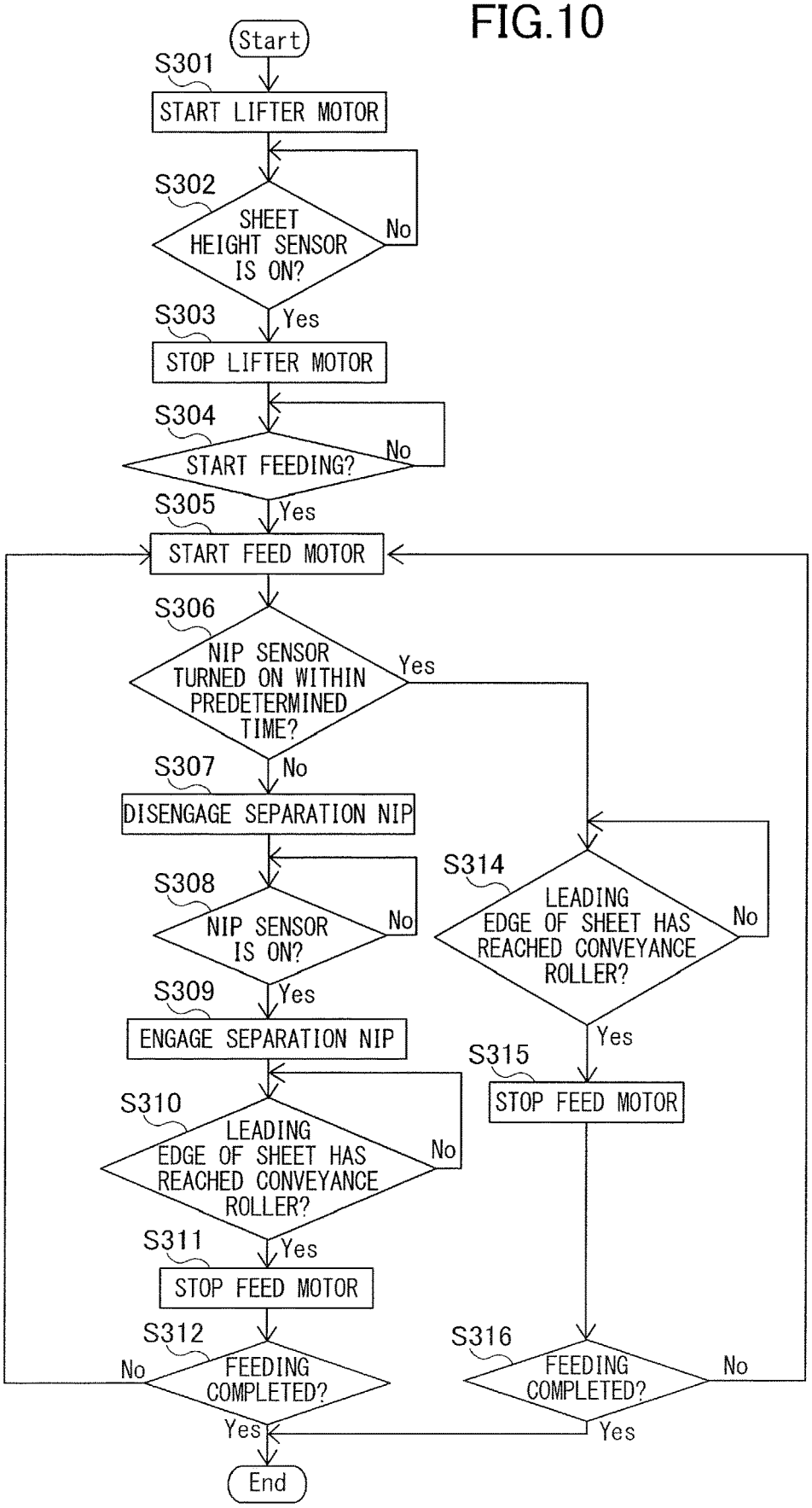
FIG. 10 is a flowchart illustrating a method for controlling a feeding operation according to a third embodiment.

Next, a sheet feeding apparatus according to a third embodiment will be described with reference to FIG. 10. A sheet feeding apparatus according to the present embodiment differs from the first and second embodiments in that the feeding of the sheet is started with the separation nip 24 set to the engaged state, and if the sheet fails to pass through the separation nip 24, the separation nip 24 is opened. Other elements having equivalent configurations and operations as the first and second embodiments are denoted with the same reference numbers as the first and second embodiments and descriptions thereof are omitted.

Now, a method for controlling feeding operation according to the present embodiment will be described with reference to the flowchart of FIG. 10. In a state where the user places the sheet P on the sheet support plate 3 and attaches the sheet feed cassette 1 to the apparatus body 201A, the sensor provided on the apparatus body 201A detects attachment of the sheet feed cassette 1. Then, the CPU 261 rotates the lifter motor 26 and starts lifting the sheet support plate 3 (S301). If the sheet support plate 3 is lifted to a position where the sheet height sensor 8 is turned on (S302: Yes), the CPU 261 stops the lifter motor 26 (S303) and stands-by until the sheet feeding operation is started. In the standby state, it is assumed that the retard roller 10 is in pressure contact with the feed roller 11.

When a feeding operation is started (S304: Yes), the CPU 261 starts rotation of the sheet feed motor 27 to feed the first sheet (S305). Then, the CPU 261 confirms the detection signal of the nip sensor 16 (refer to FIG. 3A) at a timing when a predetermined time has elapsed from the start of driving of the sheet feed motor 27 (S306). Predetermined time refers to a time required from the starting of drive of the sheet feed motor 27 to reaching of a leading end of the sheet to a detection position of the nip sensor 16 in a state where the sheet is conveyed without the pickup roller 12 and the feed roller 11 slipping on the sheet. That is, assuming that a distance from the leading edge position of the sheet set on the sheet support plate 3 to the detection position of the nip sensor 16 is X and peripheral speed of the pickup roller 12 and the feed roller 11 during the feeding operation is V, time having a length of X/V can be used as the predetermined time.

If the nip sensor 16 detects a sheet within a predetermined time from start of drive of the sheet feed motor 27 (S306: Yes), the CPU 261 determines that the sheet is conveyed without being slipped. In that case, the CPU 261 continues rotation of the sheet feed motor 27 to feed sheets from the sheet feed unit 5 without changing the state of the disengagement mechanism 25. Then, if it is determined that the sheet has reached the conveyance roller pair downstream of the separation nip 24 (S314: Yes), the CPU 261 stops the sheet feed motor 27 (S315). If a second sheet is to be fed (S316: No), the rotation of the sheet feed motor 27 is started again (S305).

Meanwhile, if the nip sensor 16 does not detect a sheet even when a predetermined time has elapsed from the start of drive of the sheet feed motor 27 (S306: No), the CPU 261 determines that sheet jamming has occurred at the separation nip 24. In that case, the CPU 261 activates the disengagement mechanism 25 in a state where rotation of the sheet feed motor 27 is continued and opens the separation nip 24 (S307). Then, the sheet enters the separation nip 24 in the disengaged state mainly by the conveyance force received from the pickup roller 12.

If it is detected that the leading edge of the sheet has passed through the separation nip 24 by the nip sensor 16 turning from off to on (S308: Yes), the CPU 261 cancels the activation of the disengagement mechanism 25 (S309). Thereby, a sheet is nipped by the feed roller 11 and the retard roller 10 in the separation nip 24. Then, while the sheet is conveyed toward the image forming unit 201B by obtaining conveyance force from both the pickup roller 12 and the feed roller 11, the sheet superposed under the sheet being fed is pushed back toward the upstream side in the sheet feeding direction by the retard roller 10. It is noted that the pickup roller 12 may be separated from the sheet after the feed roller 11 and the retard roller 10 is engaged. The reason for this is that a plurality of sheets may have entered the position corresponding to the separation nip 24 while the feed roller 11 and the retard roller 10 have been disengaged. If there are a plurality of sheets present at a position corresponding to the separation nip 24, it is necessary to push back the sheets other than the uppermost sheet to the upstream side in the sheet feeding direction by the retard roller 10. However, if the pickup roller 12 is in a state where it presses the sheet from above, the pressing force of the pickup roller 12 from above may obstruct the sheet from being pushed back. Therefore, as a method for increasing the effect of pushing back the sheet, the pickup roller 12 may be separated from the sheet.

Thereafter, if it is determined that the sheet has reached the conveyance roller pair downstream of the separation nip 24 (S310: Yes), the CPU 261 stops the sheet feed motor 27 (S311). If a second sheet is fed (S312: No), rotation of the sheet feed motor 27 is started again (S305).

In the present embodiment, occurrence of sheet jamming at the separation nip 24 is determined each time a sheet is fed (S306). That is, whether the nip sensor 16 has switched from the off state to the on state during a predetermined time from the start of driving of the sheet feed motor 27 is determined for each of the second and subsequent sheets, and based on the detection result, the contents of the feeding operation are switched. If a necessary number of sheets is fed (S312, S316: Yes), the feeding operation is completed.

As described, according to the present embodiment, after starting feeding of the sheet with the separation nip 24 set to the engaged state, if the nip sensor 16 does not detect a sheet within a predetermined time, an operation to open the separation nip 24 (S307) is performed by the disengagement mechanism 25. In other words, if the sheet sensor does not detect a sheet within a predetermined time after the sheet feed unit has started feeding of the sheet in a state where the rotary feeding member and the separation member are in contact with each other, an operation to separate the rotary feeding member and the separation member from each other is performed by the disengagement mechanism. By opening the separation nip 24, the leading edge of the sheet is enabled to pass through the position of the separation nip 24 and the jammed state of the sheet is resolved. Therefore, it becomes possible to reduce the possibility of sheet jamming of sheets such as envelopes having a large resistance when entering the separation nip 24, while maintaining the operation of the separation nip 24 to separate sheets.

According further to the present embodiment, if the nip sensor 16 detects a sheet after the separation nip 24 has been opened, the retard roller 10 is controlled to contact the feed roller 11 again. According to this configuration, the period in which the separation nip 24 is opened is suppressed to a minimum, and the possibility of occurrence of multiple feeding of the sheets can be suppressed.

Other Embodiments

According to the first to third embodiments, the disengagement mechanism 25 is activated in a state in which the sheet feed motor 27 is continued to be driven, but for example, it is also possible to open the separation nip 24 by the disengagement mechanism 25 while the sheet feed motor 27 is temporarily stopped, and then resume driving of the sheet feed motor 27. According to this operation, force from the pickup roller 12 attempting to convey the sheet toward the sheet feeding direction does not act during the operation of opening the separation nip 24. Therefore, it becomes possible to reduce the possibility of skewing of the sheet by the sheet being pushed in the sheet feeding direction at a timing in which the separation nip 24 is partially opened. Further, it is also possible to separate the pickup roller 12 from the upper face of the sheet during a period of time from temporarily stopping of the sheet feed motor 27 to the separation of the retard roller 10 from the feed roller 11, and thereafter, performing operation to move the pickup roller 12 to contact the sheet again. By performing separation and contact of the sheet and the pickup roller 12 in this manner, the sheet can be slightly vibrated. By this vibration, even if a state has occurred in which the leading edge of the sheet is slightly buckled at the vicinity of the separation nip 24 and smooth entry of the sheet into the separation nip 24 is prevented, the vibration can resolve the buckling so that the sheet can enter easily into the separation nip 24.

The elements illustrated in the first to third embodiments may be combined and adopted in one apparatus. For example, a configuration can be adopted in which a feed mode is selected based on the sheet type when the sheet type is set up in a similar way as the second embodiment, and if the sheet type is either not specified or unknown, the separation nip 24 may be opened later if necessary in a similar way as the third embodiment.

According to the first to third embodiments, the sheet feeding portion 230 serving as a sheet feeding apparatus assembled in the apparatus body 201A of the image forming apparatus 201 has been described. However, the present technique can also be applied to a manual sheet feeding portion 250. Further, it can also be applied to a sheet feeding apparatus that is provided independently from a housing of the image forming apparatus, such as a large-capacity sheet feeding apparatus arranged adjacent to the apparatus body of the image forming apparatus, or a document feeding apparatus that feeds sheets serving as documents automatically to an image reading apparatus.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-203969, filed on Oct. 20, 2017, which is hereby incorporated by reference herein in its entirety.

What is claimed is:

1. A sheet feeding apparatus comprising:

a sheet supporting portion on which a sheet is supported;

a sheet feed unit configured to feed a sheet supported on the sheet supporting portion in a sheet feeding direction, the sheet feed unit comprising a rotary feeder configured to rotate in contact with the sheet;

a separator configured to contact the rotary feeder such that a separation portion to separate the sheet fed by the rotary feeder from another sheet is formed between the rotary feeder and the separator;

a disengager configured to disengage the rotary feeder and the separator to be apart from each other;

a presser configured to press an upper face of the sheet supported on the sheet supporting portion;

a detector configured to detect displacement of the sheet in a vertical direction in a case where the presser presses the upper face of the sheet supported on the sheet supporting portion; and a controller configured to execute one mode among a plurality of modes to feed the sheet supported on the sheet supporting portion based on a detection result of the detector, the plurality of modes including a first feed mode in which the sheet is fed such that a leading edge of the sheet in the sheet feeding direction passes a position of the separation portion in a state where the rotary feeder and the separator are disengaged by the disengager, and a second feed mode in which the sheet is fed such that the leading edge of the sheet passes the separation portion in a state where the rotary feeder and the separator are engaged.

2. The sheet feeding apparatus according to claim 1, wherein the detector is configured to detect that the upper face of the sheet supported on the sheet supporting portion is at a predetermined position in the vertical direction, wherein the presser is provided on the sheet feed unit and is configured to move downward in a case where the rotary feeder is driven, and wherein the controller is configured to execute, after having started drive of the rotary feeder with the upper face of the sheet supported on the sheet supporting portion at the predetermined position, the first feed mode if the detector detects displacement of the upper face of the sheet and the second feed mode if the detector does not detect displacement of the upper face of the sheet.

3. The sheet feeding apparatus according to claim 2, wherein the sheet feed unit comprises a pickup roller arranged above the sheet supporting portion and configured to pick up and deliver the sheet supported on the sheet supporting portion to the separation portion and a holder holding the pickup roller rotatably and configured to move in the vertical direction, and wherein the presser is the pickup roller.

4. The sheet feeding apparatus according to claim 3,
wherein the sheet feed unit further comprises a gear train supported by the holding holder and configured to transmit driving force from a driving source to the pickup roller, and
wherein the gear train is arranged such that a downward moment acts on the holder through the gear train in a case where the driving source drives the pickup roller.

5. The sheet feeding apparatus according to claim 1,
further comprising a sheet sensor configured to detect the sheet at a position downstream of the separation portion in the sheet feeding direction,
wherein the controller is configured to control the disengager in executing the first feed mode such that the rotary feeder and the separator are engaged with each other after the sheet sensor detects the sheet.

6. The sheet feeding apparatus according to claim 1,
wherein the rotary feeder is a roller configured to rotate in a direction of rotation along the sheet feeding direction, and
wherein the separator is a roller to which driving force in an opposite direction from a corotating direction with the rotary feeder is transmitted.

7. The sheet feeding apparatus according to claim 1,
wherein the disengager comprises a solenoid controlled by the controller and a swinger configured to swing being driven by the solenoid so as to move the separator in a direction approaching and separating from the rotary feeder.

8. The sheet feeding apparatus according to claim 1,
further comprising an image forming unit configured to form an image on the sheet fed by the sheet feed unit.

9. A sheet feeding apparatus comprising:
a sheet supporting portion on which a sheet is supported;
a sheet feed unit configured to feed a sheet supported on the sheet supporting portion in a sheet feeding direction, the sheet feed unit comprising a rotary feeder configured to rotate in contact with the sheet;
a separator configured to contact the rotary feeder such that a separation portion to separate the sheet fed by the rotary feeder from another sheet is formed between the rotary feeder and the separator;
a disengager configured to disengage the rotary feeder and the separator to be apart from each other;
an input controller through which a sheet type of the sheet supported on the sheet supporting portion is input; and
a controller comprising a memory configured to store the sheet type input through the input controller and a processor accessible to the memory, the controller being configured to execute one mode among a plurality of modes to feed the sheet supported on the sheet supporting portion based on the sheet type stored in the memory, the plurality of modes including
a first feed mode in which the sheet is fed such that a leading edge of the sheet in the sheet feeding direction passes a position of the separation portion in a state where the rotary feeder and the separator are disengaged by the disengager, and
a second feed mode in which the sheet is fed such that the leading edge of the sheet passes the separation portion in a state where the rotary feeder and the separator are engaged.

10. The sheet feeding apparatus according to claim 9,
wherein the controller is configured to execute the first feed mode if the sheet type stored in the memory is a predetermined type and to execute the second feed mode if the sheet type stored in the memory is not the predetermined type.

11. The sheet feeding apparatus according to claim 9,
wherein the controller is configured to execute the first feed mode if the sheet type stored in the memory is an envelope and to execute the second feed mode if the sheet type stored in the memory is a plain paper.

12. The sheet feeding apparatus according to claim 9,
wherein the input controller comprises an operation display configured to display candidates for the sheet type and transmit a selected sheet type among the candidates to the controller.

13. The sheet feeding apparatus according to claim 9,
further comprising a sheet sensor configured to detect a sheet at a position downstream of the separation portion in the sheet feeding direction,
wherein the controller is configured to control the disengager in executing the first feed mode such that the rotary feeder and the separator are engaged with each other after the sheet sensor has detected the sheet.

14. A sheet feeding apparatus comprising:
a sheet supporting portion on which a sheet is supported;
a sheet feed unit configured to feed a sheet supported on the sheet supporting portion in a sheet feeding direction, the sheet feed unit comprising a rotary feeder configured to rotate in contact with the sheet;
a separator configured to contact the rotary feeder such that a separation portion to separate the sheet fed by the rotary feeder from another sheet is formed between the rotary feeder and the separator;
a disengager configured to disengage the rotary feeder and the separator to be apart from each other;
a sheet sensor configured to detect the sheet at a position downstream of the separation portion in the sheet feeding direction; and
a controller configured to control the disengager such that the sheet feed unit starts feeding the sheet in a state where the rotary feeder and the separator are engaged with each other, and if the sheet sensor does not detect the sheet within a predetermined time after the sheet feed unit has started feeding the sheet, the rotary feeder and the separator are disengaged by the disengager.

15. The sheet feeding apparatus according to claim 14,
wherein the controller is configured to control the disengager to engage the rotary feeder and the separator with each other in a case where the sheet sensor detects the sheet after the disengager has disengaged the rotary feeder and the separator.

16. The sheet feeding apparatus according to claim 15,
wherein the sheet feed unit comprises a pickup roller arranged above the sheet supporting portion and configured to pick up and deliver the sheet supported on the sheet supporting portion to the separation portion, and
wherein the controller is configured to control the pickup roller to be separated from the sheet after the rotary feeder and the separator are engaged.

17. The sheet feeding apparatus according to claim 14,
wherein the sheet feed unit comprises a pickup roller arranged above the sheet supporting portion and configured to pick up and deliver the sheet supported on the sheet supporting portion to the separation portion, and
wherein the controller is configured to control the pickup roller to convey the sheet during a period in which the rotary feeder and the separator are disengaged by the disengager.

18. The sheet feeding apparatus according to claim 14, wherein the controller is configured to control the sheet feed unit and the disengager such that if the sheet sensor does not detect the sheet within the predetermined time after the sheet feed unit has started feeding the sheet, the rotary feeder and the separator are disengaged in a state where the sheet feed unit is stopped, and thereafter, the sheet feed unit is restarted.

* * * * *